United States Patent [19]

Grantham

[11] Patent Number: 4,626,201

[45] Date of Patent: Dec. 2, 1986

[54] COMBUSTION CHAMBER FOR A COMMERCIAL LAUNDRY DRYER

[76] Inventor: Charles R. Grantham, 1720 Pacific Ave., Venice, Calif. 90291

[21] Appl. No.: 743,371

[22] Filed: Jun. 11, 1985

[51] Int. Cl.[4] ..... F27B 7/36; F27B 7/06; F24H 1/00

[52] U.S. Cl. ..... 432/105; 432/113; 432/222

[58] Field of Search ..... 432/29, 105, 113, 222; 34/133

[56] References Cited

U.S. PATENT DOCUMENTS 1,311,235 7/1919 Kemp et al. ..... 432/29

2,486,315 10/1949 Morris ..... 432/105

2,654,219 10/1953 Zaba ..... 432/222

3,861,865 1/1975 Grantham ..... 432/105

*Primary Examiner*—John J. Camby

*Attorney, Agent, or Firm*—Henry M. Bissell

[57] ABSTRACT

A combustion chamber for supplying heated air to a commercial dryer utilizes a back-mounted burner firing through coaxial cylinders of different diameters contained in the combustion chamber to heat air drawn through the larger cylinder. Additional fresh air in a secondary passage alongside the larger cylinder is selectively controlled to reduce the temperature of air flowing through the cylinder for the protection of the laundry articles in the dryer.

48 Claims, 6 Drawing Figures

COMBUSTION CHAMBER FOR A COMMERCIAL LAUNDRY DRYER

BACKGROUND OF THE INVENTION

1. Field of the Invention

The present invention relates generally to the field of laundry and other article-drying equipment and, more particularly, to an improved combustion chamber used to advantageously provide large volumes of very hot air to high-production commercial dryers.

2. Description of the Prior Art

An overall view of typical prior art in industrial laundry dryer-conditioners, generally referred to in the industry as merely "dryers", may be found by referring to U.S. Pat. Nos. 2,604,313, 2,643,463, 3,443,323, 3,861,865 and 4,015,930. Dryers such as those discussed in these patents and, for that matter, industrial dryers in general, require large volumes of air having a temperature, in the tumbler of the dryer, in the range of 300° to 350° F., which elevated temperature air flow combines with the tumbling action of the dryer to achieve rapid, yet safe, drying.

The high temperature of the air flowing through the dryer is achieved by the burning of fuel such as natural gas, propane, butane, or fuel oil in a combustion chamber from which hot air is supplied to the dryer housing, generally with the aid of an air pump or blower. The fuel is mixed with appropriate portions of air to obtain clean burning of the fuel, and is introduced into the combustion chamber under pressure. Internal temperatures in the combustion chamber may typically range from 400° to 700° F., and it may therefore be apprecited that the high temperature of operation is a factor in the design of the combustion chamber.

The present state-of-the-art of the combustion chamber is illustrated in U.S. Pat. No. 3,861,865, and utilizes double wall construction with between-wall cooling by intake (make-up) air as well as an air barrier to eliminate the need for a refractory endpiece. While this design offers significant advantages over previous such combustion chambers, it has, as do other previous designs, several disadvantages which are discussed at length below. The solution to these disadvantages in a combustion chamber offering at least as economic and dependable operation as presently existing devices will present to its manufacturer a significant competitive advantage in the industry.

The first of these problems is related to the placement of the burner in the front wall of the combustion chamber. At best it is inconvenient to have the burner in the front of the dryer, since the fuel line must be routed around to the front of the machine. Since the portion of exhaust from the dryer which is to be recirculated back into the dryer with the hot air flow in present devices enters the combustion chamber at the end opposite the burner, it is apparent that the flow of hot gas generated by the burner will move in a direction opposite to the flow of exhaust gas which is being recirculated. This counterflow problem results in a loss in efficiency due to swirl occurring in the combustion chamber, as well as making the regulation of the amount of exhaust gas recirculated relatively difficult to control.

A closely related problem is caused by the differing locations at which fresh air is supplied to the dryer and exhaust air is purged from the dryer. In the arrangement shown in U.S. Pat. No. 3,861,865, fresh air enters the combustion chamber from both ends of the dryer, and exhaust air leaves through an exhaust stack at the back of the dryer. It has been found desirable to have a more hermetically sealed combustion chamber, where both fresh air and exhaust air flows are supplied through ducting at the same end of the chamber. This simplifies the construction of the chamber and permits better control of the air flow.

In addition, the preferred method of supplying fresh air and removing exhaust air is to use a coaxial tube arrangement, with the fresh air being ducted in a tube contained within the stack carrying out the exhaust air. This technique offers the advantage fo preheating the fresh air without expending any further energy, thereby reducing the amount of fuel which must be burned to heat the fresh air prior to supplying it to the dryer. This type of ducting arrangement is difficult to use with a combustion chamber having the air intake on one end of the combustion chamber and the exhaust on the other end, and bulky and expensive manifolds and added ducting work only with diminished efficiency. It is therefore apparent that it is highly desirable to have the fresh air intake as close to the exhaust as possible, and it is further desirable to have the system hermetically sealed.

A further problem in existing combustion chambers for dryers relates to the problems of temperature control and air mixture. Clothing in the dryer can tolerate a fairly high temperature when wet, in the neighborhood of 300°-350° F., as stated above. However, when the clothes are about 25% through the drying cycle, although still damp, they can no longer tolerate higher temperatures without scorching. Accordingly, the temperature should be reduced at this point in the drying cycle. One way to do this is by reducing the level of the burner. It is desirable to effect this reduction in temperature by the introduction of a greater amount of cooler fresh air, rather than to lower the temperature exclusively by lowering the level of the burner.

It may therefore be seen that a number of areas for improvement exist with respect to combustion chambers for dryers. It is of course also apparent that while the combustion chamber should be as inexpensive to purchase as possible, the efficiency of operation is most important, since even small gains in efficiency translate over a long period into relatively large savings. Finally, it is desirable that an improved combustion chamber may be retrofitted onto older dryers so the operators of such dryers may also obtain the attendant advantages of the improved combustion chamber.

SUMMARY OF THE INVENTION

The present invention utilizes a radical redesign of the combustion chamber of a dryer to solve the above problems and to achieve the above advantages. The combustion chamber of the present invention is a hermetically sealed unit, and it features a design having the burner mounted in back. The burner fires into a first or burner cylinder which is open at the end away from the burner. A second or heating cylinder of a larger diameter than the burner cylinder overlaps the burner cylinder, and the flame from the burner extends through the heating cylinder.

Fresh air enters through the end of the heating cylinder overlapping the burner cylinder, with the fresh air passing through the clearance between the heating cylinder and the burner cylinder. Exhaust gas passes around the heating cylinder, and a portion of the exhaust gas may be recirculated through the dryer by selectively opening or closing an exhaust gate. The exhaust air is separated from the fresh air only by a single wall, and the coaxial ducting arrangement discussed above may be utilized with a minimum of difficulty. The direction recirculated exhaust gas takes is no longer opposed to the direction of hot gases from the burner, and swirl losses are thereby minimized.

A slide gate is utilized to selectively provide cooler air to the air mix supplied to the dryer to prevent scorching of clothes after the first 25% of the cycle. A deflector shield is provided to accomplish mixing of the cooler air with the heated air. A heat shield with a perforated portion is supplied at the front of the combustion chamber, with a glass window provided in the housing to allow observation for adjustment of the flame provided by the burner.

Since most of the heating is done inside the two cylinders, double wall construction is unnecessary, resulting in a more economical construction. Another added feature afforded by the particular arrangement of the combustion chamber, with the burner mounted on the opposite side of the exhaust passage from the dryer inlet opening, is the length of the flame extending from the burner, which is longer than the flame in other types of combustion chambers. The added flame length allows better mixing with the air, for cleaner and more efficient operation. It may therefore be appreciated that the present invention is a substantial improvement over the art, and provides a hermetically sealed combustion chamber for a commercial dryer which is more efficient than those previously known.

The burner, located in the back of the combustion chamber, no longer fires into the exhaust stream but through the exhaust stream, which travels around the flame. The exhaust and fresh air paths are adjacent, allowing coaxial ducting to be used. Both exhaust recirculation and cool air mixing are easily accomplished with a high degree of control. The combustion chamber of the present invention is adaptable to being retrofitted onto older dryers, making its commercial potential high for both manufacturers and end users. These significant advantages are all provided by the present invention without substantial disadvantage, making the present invention a highly desirable improvement in the art.

BRIEF DESCRIPTION OF THE DRAWINGS

A better understanding of the present invention may be had from a consideration of the following detailed description, taken in conjunction with the accompanying drawings in which.

DETAILED DESCRIPTION OF THE PREFERRED EMBODIMENT

Figure 1:
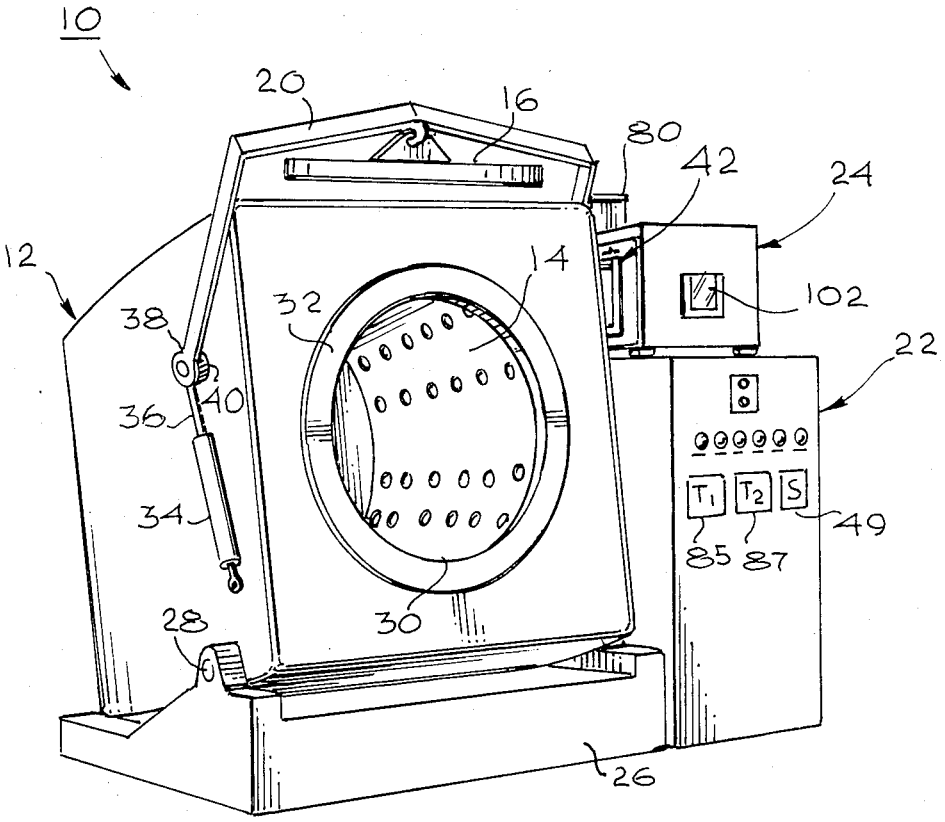
FIG. 1 is a perspective view, in elevation, of a dryer system incorporating the present invention.

In FIG. 1 a commercial dryer system 10 is shown which includes a housing 12 which rotatably supports a basket 14 within said housing 12. A cover 16, shown in FIG. 1 in its removed position, is supported by an arm 20. A control center 22 contains the controls for the dryer system 10 and operates the various cycles and positions of the dryer system 10. A combustion chamber 24, mounted on top of the control center 22, heats the air used in the drying process. The housing 12 is tiltably supported by a base 26.

The housing 12 is shown in FIG. 1 in its loading position, in which it is tilted back by mechanical means (not shown) operated by the control center 22. The axis of rotation of the housing 12 is about journal 28 and a corresponding journal (not shown) on the opposite side of the housing 12. In this loading position the cover 16 is in the removed position shown, away from a front opening 30 in the housing 12 through which laundry may be loaded into the basket 14. The front opening is surrounded by a gasket 32 for sealing the opening whenever the cover 16 is in place over the front opening 30.

This control center 22 includes various switches, lights, relays, timers, sensor controls and similar elements of conventional construction. For purposes of describing the present invention, the control console includes a cycle timer 85 and a division timer 87. The timer 85 is set to determine the length of the drying cycle and the timer 87 picks off a selected portion of that time period (say 25%) to perform a particular operation of the present invention, to be explained bwlow. The console 22 may also include a sensor control stage 49 to develop a desired response to the sensing of particular operating conditions, such as the humidity of the recirculating air, for example.

A cover positioner 34 is used which may be a pneumatic or hydraulic actuator which cooperates through a chain member 36 with teeth 38 on a gear member 40 to which the arm 20 is secured, the gear member 40 being rotatably mounted on the housing 12. When the positioner 34 receives a signal from the control center 22, the positioner 34 pulls downwardly on the chain member 36, causing the gear member 40 to rotate and raising the cover 16 away from its position in cooperation with the gasket 32 surrounding the front opening 30 in the housing 12. A similar mechanism may be provided on the opposite side of the housing 12, particularly if the cover 30 is of heavy construction.

While the combustion chamber is stationary, since it is connected to ducting (not shown) to supply fresh air and to remove exhaust air, a coupling 42 allows the housing 12 to move relative to the combustion chamber 24. It is through this coupling 42 that the heated air passes as it is supplied to the housing 12 of the dryer system 10 from the combustion chamber 24. The details of construction fo the dryer system 10 illustrated in FIG. 1 are used as an example to illustrate the novel combustion chamber 24 which is the heart of the subject invention. It is important to note that the combustion chamber disclosed herein may be used with many different dryers other than the type illustrated, both of the single load type shown in FIG. 1 and the continuous operation type described in U.S. Pat. No. 4,015,930.

Figure 2:
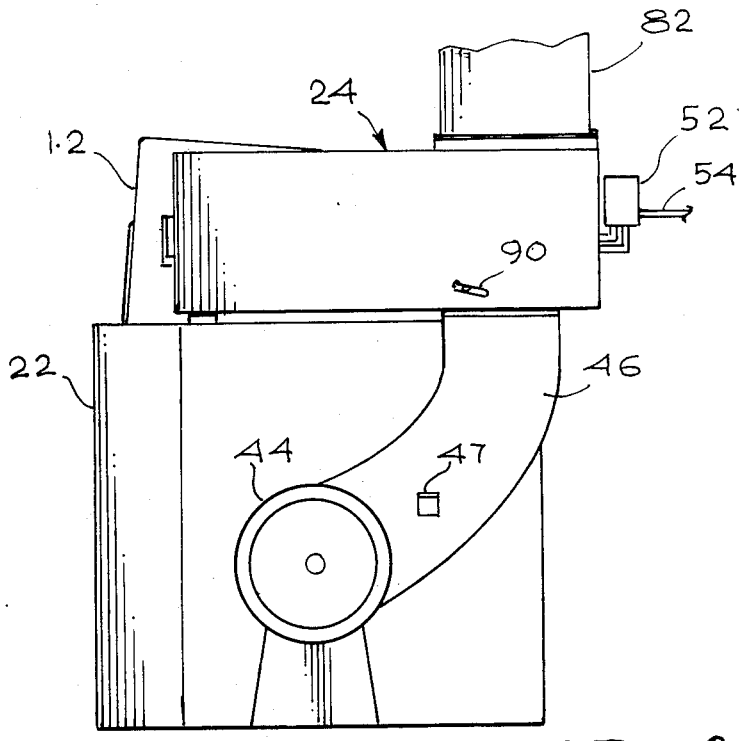
FIG. 2 is a side view of the combustion chamber and blower of FIG. 1 with the air-fuel mixing and introduction means simplified.

Referring now to FIG. 2, the right side of the dryer system 10 is illustrated, showing the air circulation apparatus. As mentioned above, the hot air is supplied from the combustion chamber 24 to the housing 12 through the coupling 42. Hot air is used in the housing 12 to aid in the rapid drying of laundry contained in the dryer 10 and tumbling in the basket 14. Exhaust air is drawn out of the housing 12 by a blower 44 through an aperture (not shown) in the housing 12. The blower 44 pulls the exhaust air out of the housing 12, and forces it through a duct 46 into the bottom of the combustion chamber 24. This creates a negative pressure in the housing 12 and acts to draw heated air into the housing 12 from the combustion chamber 24. With the exception of the connection of the duct 46 to the combustion chamber 24 and the coupling 42, the dryer system as described to this point is as known in the art. It is the particular construction of the combustion chamber 24 and its interfaces with the duct 46 and the housing 12 through the coupling 42 that departs from the art and is discussed below. A sensor 47 is mounted to extend into the duct 46 for sensing air conditions, such as humidity for example. This is used to control particular elements included in the combustion chamber, explained below.

Figure 3:
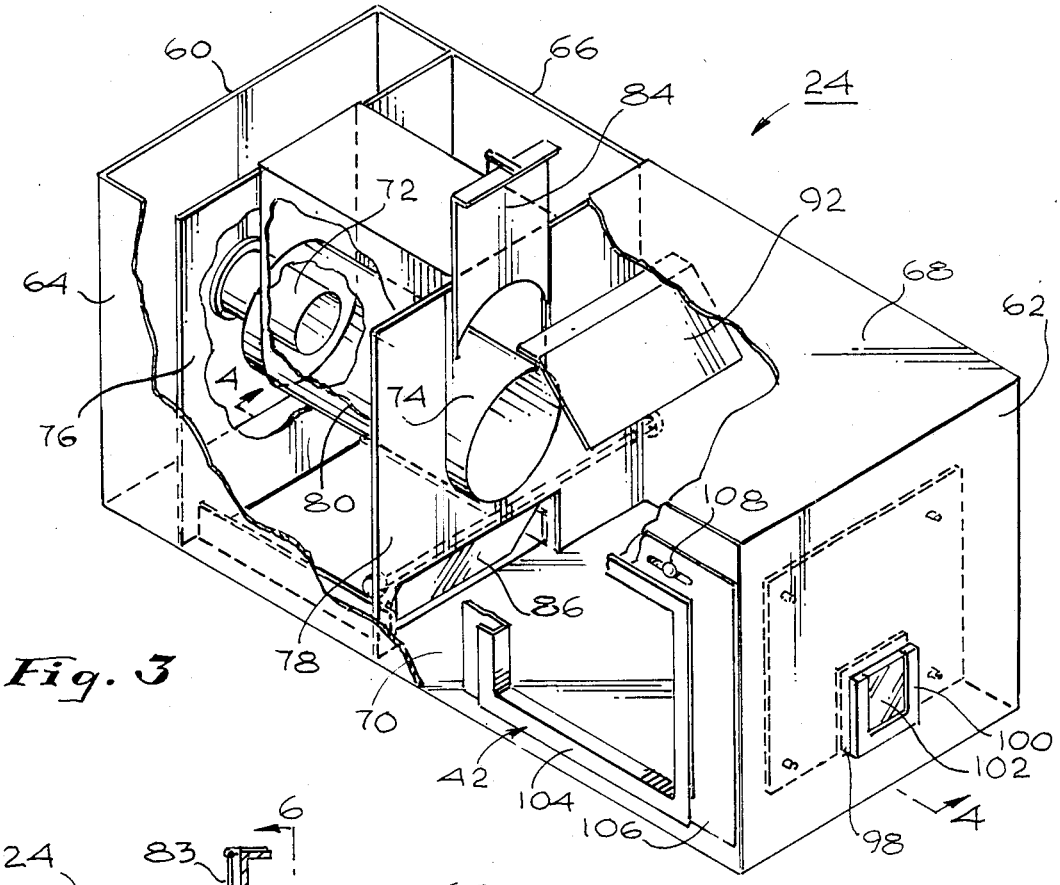
FIG. 3 is a perspective view, in elevation, of the combustion chamber of FIG. 1 with the first side wall and the top wall partially cut away.
Figure 4:
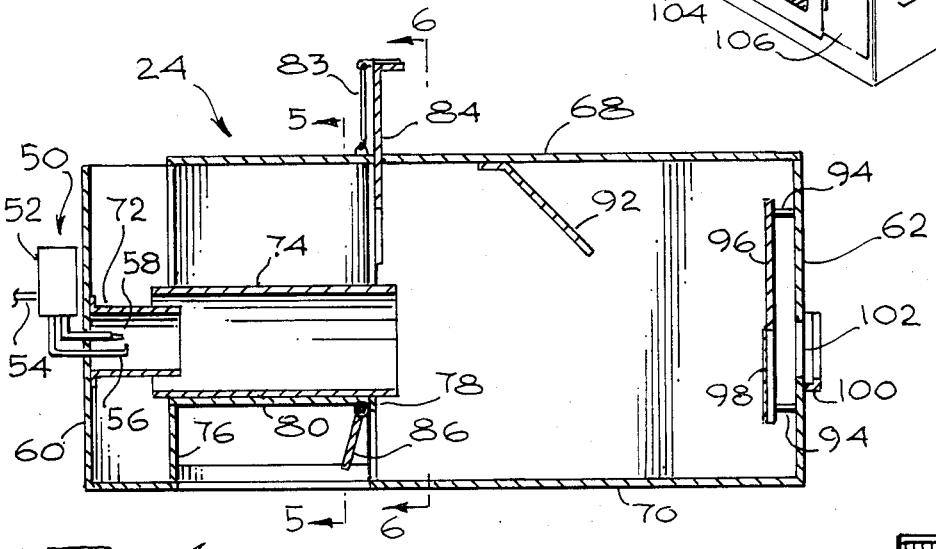
FIG. 4 is a sectional view of the combustion chamber of FIG. 3, with both the exhaust gate and the slide gate partially open.

Referring now to FIGS. 3 and 4, the combustion chamber which is the heart of the present invention is illustrated in considerable detail. It will immediately be noted that a burner assembly 50 is mounted on the back of the combustion chamber 24, rather than on the front as is conventional. The burner assembly 50 is shown in rather simplified form and comprises a fuel-gas mixing chamber 52 which receives fuel through a pipe 54, as well as air, which is usually under pressure and supplied from the blower 44. The chamber 52 may also have an automatic flap valve (not shown) which adjusts the air input to the mixture as the fuel flow changes. A pilot 56 is typically provided to light the air-fuel mixture issuing from a jet 58 when the system 10 is operating to dry clothes.

There are a number of conventional safety features, such as automatic shut-off of the fuel valve if the pilot is inadvertently extinguished and interlocking features which automatically shut down the system 10 if any of the normal conditions for operation of the system 1 are departed from, which are not specifically explained herein since they are well known in the art. A pilotless ignition of the electronic variety may also be used, which variety is well known in the art. Note that the burner assembly 50 is not shown in FIG. 3, for purposes of clarity, but that it extends through a back wall 60 of the combustion chamber 24.

Figure 5:
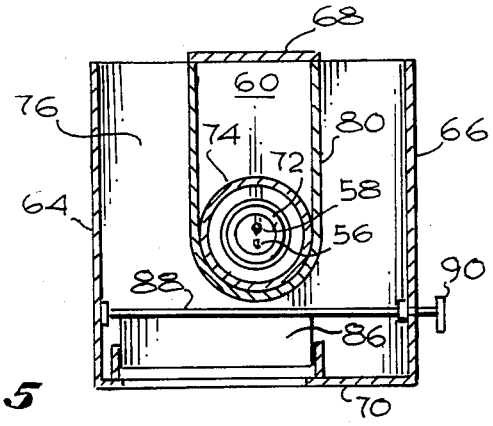
FIG. 5 is a sectional view of the combustion chamber of FIGS. 3 and 4.
Figure 6:
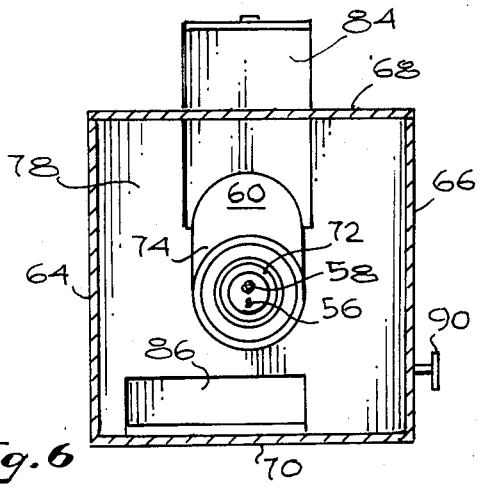
FIG. 6 is a further sectional view of the combustion chamber of FIGS. 3 and 4.

Referring now to FIGS. 3–5, the combustion chamber 24 is enveloped by walls on all sides, making it a hermetically sealed chamber. In addition to the aforementioned back wall 60 on which the burner assembly 50 is mounted, there is a front wall 62 opposite the back wall 60, a first side wall 64 which is adjacent the housing 12 (FIG. 1) and between the front wall 62 and the back wall 60, and a second side wall 66 opposite the first side wall 64 and between the front wall 62 and the back wall 60. There are also a top wall 68 and a bottom wall 70, both of which have apertures therein which will be described below. In one particular embodiment, all of the walls of the combustion chamber 24 are made of 14 gauge metal, preferably steel, and it should be noted that the combustion chamber is of single wall construction. In the preferred embodiment, the front and back walls 60, 62 are approximately 36 inches square.

The burner assembly 50 is mounted approximately in the middle of the back wall 60, with the jet 58 and the pilot 56 extending through the back wall 60 into the interior of the combustion chamber 24. A burner cylinder 72 is mounted on the interior side of the back wall 60, and extends around the jet 58 and the pilot 56 and into the interior of the combustion chamber toward the front wall 62. The end of the burner cylinder 72 extending toward the front wall 62 is open, and the burner cylinder 72 extends approximately 7 inches from the end wall 60.

A heating cylinder 74, which is open on both ends and which is of larger diameter than the burner cylinder 72, is mounted coaxially with and slightly overlapping the burner cylinder 72. The heating cylinder 72 extends through two walls supporting it at its ends, with both of these walls being parallel to and intermediate the back wall 60 and the front wall 62, and extending between the first and second side walls 64, 66 and the top and bottom walls 68, 70. A separation wall 76 supports the heating cylinder 74 at the end nearer the back wall 60, and a gate wall 78 supports the heating cylinder at the end nearer the front wall 62. The heating cylinder 74 is approximately 22 inches long. The specific configuration utilizing the coaxial, slightly overlapping cylinders as the location of the burner flame obviates the need for double wall construction, thereby reducing the cost of manufacture.

The separation wall 76 has a U-shaped aperture therein, with the aperture extending to the top of the separation wall 76 and the rounded portion of the aperture corresponding to the bottom of the U holding the heating cylinder 74 therein. The gate wall 78 has a similar U-shaped aperture in the same orientation. In addition, the gate wall 78 has a rectangular aperture on the bottom adjacent the bottom wall 70.

There is an additional wall which is a U-shaped wall 80. The rounded portion of the U-shaped wall 80 surrounds the lower half of the heating cylinder 74, with the legs of the U-shaped wall 80 extending upward from the sides of the heating cylinder to the top wall 68. The U-shaped wall 80 extends between the separation and gate walls 76, 78. The intersections between the walls themselves, and the walls and the cylinders are sealed, as by welding.

Note that the bottom wall 70 has an aperture therethrough, which aperture is located between the separation wall 76 and the gate wall 78. This aperture is for exhaust air returned under pressure from the housing 12 through the duct 46 by the blower 44 (FIG. 2). The exhaust air passes into the combustion chamber 24 through the aperture in the bottom wall 70, and leaves the combustion chamber through two apertures in the top wall 68, which two apertures correspond to the legs of a U and are between the separation and gate walls 76, 78 and the first and second side walls 64, 66 and the U-shaped wall 80. Note that the exhaust air thus passes around the heating cylinder 74, through which the flame from the burner assembly 50 extends. Thus, the burner assembly 50 fires through the exhaust. This also helps improve the economy of the device slightly, since the hot exhaust air will act to heat the air passing through the heating cylinder 74 and any fresh air passing within the chamber formed by the U-shaped wall 80.

Fresh air is supplied to the combustion chamber 24 through an aperture in the top wall 68. This aperture is between the back and separation walls 60, 76 and the first and second side walls 64, 66. The primary path of fresh air is through this aperture and into the clearance between the heating cylinder 74 and the burner cylinder 72, and then into the heating cylinder 74. It may thereby be appreciated that fresh air enters the combustion chamber 24 on one side of the separation wall 76, and exhaust air exits the combustion chamber 24 on the other side of the separation wall 76. This proximity makes possible the expeditious connection of the combustion chamber 24 to a coaxial duct arrangement at the base of an exhaust/intake stack through a simple manifold 82 (FIG. 2). Note that this achieves the significant advantage of using the heat of exhaust air to preheat the incoming fresh air.

In addition to the primary path for fresh air mentioned above, fresh air may also move in a secondary path through the same aperture into the area between the legs of the U-shaped wall 80 and the top wall 68 and the heating cylinder 74. Slidably mounted over the portion of the U-shaped aperture in the gate wall 78 above the heating cylinder 74 is a slide gate 84, which may be used to selectively open or close the secondary path of fresh air. The slide gate 84 would typically be closed when beginning the drying cycle, and would be opened about 25% into the cycle to cool the temperature of the air supplied to the dryer, as will be more apparent below. The slide gate 84 is shown coupled to an actuator 83 to control the movement and position of the gate. The actuator 83 is controlled from the control center 22 by either or both of the division timer 87 and the sensor control stage 49.

Also located near the gate wall 78 is an exhaust gate 86, which is used to recirculate a portion of the exhaust air entering the combustion chamber 24 through the aperture in the bottom wall 70. The exhaust gate 78, shown best in FIGS. 4 and 5, is mounted on a rod 88 which may be turned by a gate control lever 90. When opened, the exhaust gate 86 allows some exhaust air to flow through the rectangular aperture in the gate wall 78, to be recirculated back to the dryer.

Approximately half of the combustion chamber is located between the gate wall 78 and the front wall 62. It is in this portion that the air to be supplied to the dryer will be made up, and the components of that air are heated air entering through the heating cylinder 74, cooler air passing through the slide gate 80, and recirculated exhaust air passing through the exhaust gate 86. There is a deflector shield 92 mounted on the top wall 68 and extending downward at an angle to help mix cooler air coming through the slide gate 80 with the hotter air coming from the heating cylinder and through the exhaust gate 86.

Located at the end of the combustion chamber near the front wall 62, and offset from the front wall 62 by spacers 94, is a heat shield 96. Located in a portion of the heat shield having an aperture is a perforated shield 98. The front wall 62 has an aperture therein, with a frame 100 disposed around the aperture, and a piece of heat-resistant glass 102 such as Pyrex disposed in the frame 100. An observer can look through the glass 102 and the perforated shield 98 to observe and adjust the flame coming from the burner 50.

Referring now to FIG. 3, the aperture in the first side wall 64 through which hot air is supplied to the housing 12 (FIG. 1) has the coupling 42 mounted therein. The coupling 42 includes an angled portion 104 having two 90° bends in the cross section thereof and arranged in a rectangular configuration in the aperture in the first side wall 64. The angled portion 104 is basically U-shaped in cross section, with the U fitting around the edges of the aperture in the first side wall 64. A flat plate 106 having a rectangular aperture therein is mounted around the angled portion outside of the first side wall 64. A bolt 108 extends through the flat plate 106, the first side wall 64, and the angled portion 104 inside the first side wall 64, and slots in the parts allow the coupling 42 to move considerably toward the front and back of the combustion chamber 24, with a lesser degree of movement being allowed around the axis of the bolt 108. This movement in the coupling allows adjustment of any space between the coupling 42 and the facing opening in the dryer housing 12, thereby facilitating final adjustments during mounting of the combustion chamber 24 in the dryer system 10.

The operation of the combustion chamber 24 will now be discussed briefly, with particular reference to FIGS. 3 and 4. The blower 44 (FIG. 2) is started to circulate air through the housing 12 (FIG. 1), with heated air being drawn into the housing 12 from the combustion chamber 24 as a result of exhaust air being pulled out of the housing 12 by the blower 44. The burner assembly 50 produces a flame that extends through the heating cylinder 74 toward the front end 62 of the combustion chamber 24, with the flame produced by the combustion chamber of the present invention extending substantially the full length of the chamber (approximately six feet for the embodiment described) for better mixing with the air being supplied to the dryer.

Fresh air enters the heating cylinder 74 in the area between the heating cylinder 74 and the burner cylinder 72, and is heated by the flame as it passes through the heating 74. At the start of the cycle, both the slide gate 80 and the exhaust gate 86 are closed. Hot air is supplied through the aperture 42 in the first side wall 64 to the dryer housing 12. As the exhaust air heats up, the exhaust gate 86 may be opened to recycle a portion of the exhaust air.

When the cycle is about 25% through, the slide gate 80 is opened to cool the air supplied to the housing 12 slightly, to avoid scorching the clothes in the dryer 10. Note that the gate 80 may be controlled manually or by the control center 22, which may also control the opening of the exhaust gate 86. Automatic control of the gate 80 may be effected by the division timer 87, coupled to cycle timer 85, or it may be responsive to humidity of the dryer exhaust air as sensed by the sensor 47 (FIG. 2) which provides an output signal to the sensor control 49 for driving the actuator 83.

When the opening of the gate 80 is controlled manually or by automatic control from the division timer 87, it is preferable to open the gate gradually or by stages, beginning with the time that the gate starts opening at about 25% through the dryer cycle. The actuator 83 is then controlled to continue the opening of the gate 80, either continuously or by stages, over the remaining 75% of the dryer cycle in response to the division timer 87.

When the control of the opening of the gate 80 is effected by the actuator 83 responding to an output signal from the humidity sensor control element 49, it is arranged to begin opening the gate 80 when the humidity of the dryer exhaust air (which begins at a maximum level) reduces to a predetermined threshold value. Thereafter, the opening of the gate continues gradually in proportion to the reduction of exhaust air humidity until a minimum level is reached corresponding to the drying of the laundry being completed, at which point the gate 80 is fully opened.

It is apparent that the present invention presents substantial advantages over the art, the most important being that it is a more efficient combustion chamber than those previously known. It is therefore a desirable unit both to produce and to utilize. It has the burner at the back of the unit, a more desirable location, and the burner fires through the exhaust, rather than opposing the exhaust and resulting in diminished efficiency.

The combustion chamber of the present invention allows better control of both exhaust air recirculation and introduction of cooler air at a particular point in the cycle. The combustion chamber is also hermetically sealed, and susceptible to easily utilizing coaxial fresh air intake and exhaust air ducts, thereby further increasing efficiency. Finally, it is also able to retrofit onto a wide variety of existing dryers, making its appeal broad from an economic standpoint due to the increased efficiency and lower operating cost of the improved combustion chamber.

Although there have been described above specific arrangements of a combustion chamber for a commercial laundry dryer in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A combustion chamber for providing a large quantity of heated air for drying articles in a dryer-conditioner system, comprising:

an enclosure having a front wall and a back wall;

a flame source installed on said back wall with the flame from said flame source directed toward said front wall;

a burner cylinder mounted on said back wall around said flame source, said burner cylinder having an open end directed toward said front wall;

a heating cylinder located in a position coaxial to and slightly overlapping said burner cylinder, said heating cylinder having a larger diameter than said burner cylinder and being nearer said front wall than is said burner cylinder;

means for directing fresh air into the area between said heating and burner cylinders through the end of said heating cylinder which is nearer said back wall and into said heating cylinder to heat said fresh air by said flame; and means for directing the heated air to said dryer-conditioner system after flowing through said heating cylinder.

2. The combustion chamber of claim 1 wherein said enclosure further comprises a first side wall between said front and back walls, said first side wall having an aperture therein through which said heated air is provided to said dryer-conditioner; a second side wall opposite said first side wall and between said front and back walls; a top wall between said first and second side walls; and a bottom wall between said first and second side walls.

3. The combustion chamber of claim 2 further comprising a separation wall parallel to said front and back walls for supporting said heating cylinder at the end of said heating cylinder nearer said back wall, said separation wall extending between said first and second side walls and between said top and bottom walls, said separation wall having a U-shaped aperture therein with said heating cylinder resting in the rounded portion of said U-shaped aperture, said U-shaped aperture extending to said top wall; a gate wall parallel to said front and back walls for supporting said heating cylinder at the end of said heating cylinder nearer said front wall, said gate wall extending between said first and second side walls and between said top and bottom walls, said gate wall having a U-shaped aperture therein with said heating cylinder resting in the rounded portion of said U-shaped aperture, said U-shaped aperture extending to said top wall; and a U-shaped wall with the rounded portion thereof surrounding the lower half of the heating cylinder between said separation and gate walls, with the legs of said U-shaped wall extending upward from the sides of said heating cylinder to said top wall, said U-shaped wall extending between said separation and gate walls.

4. The combustion chamber of claim 3 wherein said aperture in said first side wall through which said heated air is provided to said dryer-conditioner is located between said gate and front walls.

5. The combustion chamber of claim 3 wherein said bottom wall has an aperture therein between said separation and gate walls through which exhaust air from said dryer-conditioner may enter said combustion chamber, said exhaust air flowing around said heating cylinder and exiting said combustion chamber through a pair of apertures in said top wall defined by and between said separation and gate walls and said first and second walls and said U-shaped wall.

6. The combustion chamber of claim 5 wherein said gate wall has a rectangular aperture therethrough adjacent to said bottom wall through which a portion of the exhaust air entering said combustion chamber through said aperture in said bottom wall may be recirculated back to said dryer-conditioner.

7. The combustion chamber of claim 6 additionally comprising an exhaust gate for selectively controlling exhaust air recirculation by limiting the extent of the rectangular aperture in said gate wall adjacent said bottom wall.

8. The combustion chamber of claim 5 further including means defining an aperture in said top wall bounded by said first and second side walls and said back and separation walls for admitting fresh air to the chamber.

9. The combustion chamber of claim 8 wherein the aperture through which fresh air enters said combustion chamber and said pair of apertures through which exhaust air exits said combustion chamber are adjacent one another.

10. The combustion chamber of claim 9 which is relatively configured and arranged so the primary path of fresh air in said combustion chamber is into said heating cylinder through the clearance between said heating cylinder and said burner cylinder, following which said fresh air is heated and then circulated to said dryer-conditioner.

11. The combustion chamber of claim 8 additionally comprising a slide gate which may be selectively opened or closed to control fresh air in a secondary path through the portion of said U-shaped aperture in said gate wall between said heating cylinder and said top wall.

12. The combustion chamber of claim 11 further including means for opening said slide gate approximately 25% into the drying cycle to reduce the temperature of heated air supplied to said dryer-conditioner.

13. The combustion chamber of claim 11 additionally comprising a deflector shield mounted on said top wall and angled to deflect fresh air flowing in said secondary path downwardly to effect a mixing of the cooler air in said secondary path with the heated air to thereby provide a uniformly heated mixture of air.

14. The combustion chamber of claim 5 wherein said exhaust air passing around said heating cylinder has the effect of heating air passing through said heating cylinder.

15. The combustion chamber of claim 4 additionally comprising coupling means installed in said aperture in said first side wall for allowing adjustment of the spacing between said combustion chamber and a housing containing the articles to be dried.

16. The combustion chamber of claim 1, additionally comprising a heat shield mounted within the chamber in an offset position from said front wall by spacers.

17. The combustion chamber of claim 16 wherein said heat shield has an aperture therein, said combustion chamber additionally comprising a perforated shield portion mounted in said aperture in said heat shield; and a glass window located in said front wall to allow an observer to look through said window and said perforated shield at said flame to observe or adjust said flame.

18. A combustion for a laundry article-drying device or the like, comprising:

a front wall;

a back wall having a flame source mounted thereon;

a burner cylinder mounted at one end to said back wall around said flame source, said burner cylinder having an open end facing said front wall; and a heating cylinder coaxial with and slightly overlapping said burner cylinder, said heating cylinder having a larger diameter than said burner cylinder to provide a clearance for fresh air entering between said heating and burner cylinders into said heating cylinder.

19. A combustion chamber for use with a high-production commercial dryer-conditioner requiring large volumes of heated air to dry laundry articles comprising:

a front wall;

a back wall having a burner assembly for providing a flame mounted therein, said burner assembly directing said flame toward said front wall;

a burner cylinder mounted at one end of said back wall around said burner assembly, the other end of said burner cylinder being open and extending toward said front wall;

a heating cylinder located coaxial with and slightly overlapping said burner assembly, said heating cylinder being open on both ends and of a larger inner diameter than the outer diameter of said burner cylinder;

a separation wall for mounting parallel to said front and back walls, said separation wall having an aperture therein for receivably supporting the end of said heating cylinder nearer said back wall;

a gate wall for mounting parallel to said front and back walls, said gate wall having an aperture therein for receivably supporting the end of said heating cylinder nearer said front wall;

side walls between said front and back walls, one of said side walls having an aperture therein between said gate and front walls through which heated air is supplied from said combustion chamber to said dryer-conditioner; and a top wall between said front and back walls, said top wall having an aperture therein between said back and separation walls for supplying fresh air to said combustion chamber.

20. A drying system for drying articles by the flow of heated air, comprising:

a housing having an air inlet for heated air and an air outlet for exhaust air;

means within said housing for supporting said articles to be dried;

a combustion chamber having a flame source at the back end thereof, with a burner cylinder mounted on said back end around said flame source, said burner cylinder having an open end directed toward the front end of said combustion chamber, said combustion chamber also having a heating cylinder of larger diameter than said burner cylinder mounted in said combustion chamber coaxially with said burner cylinder, said combustion chamber supplying heated air from an aperture therein; and blower means for removing exhaust air from said housing and consequently causing heated air to be drawn from said combustion chamber into said housing.

21. A combustion chamber for a device for drying articles by the flow of heated air comprising:

a back wall having a flame source mounted therein;

a front wall opposite said back wall;

wall means for forming a chamber between said front and back walls;

a burner cylinder mounted on said back wall about said flame source, said burner cylinder having an open end extending toward said front wall;

a heating cylinder mounted coaxially with and slightly overlapping said burner cylinder, said heating cylinder having a greater diameter than said burner cylinder;

fresh air conduit means for supplying fresh air to said heating cylinder through a path between said heating and burner cylinders; and heated air conduit means for supplying heated air from said combustion chamber to said device.

22. A method for providing a large quantity of heated air for drying articles in a dryer-conditioner system or the like, comprising:

providing an enclosure having a front wall and a back wall;

installing a flame source on said back wall with the flame from said flame source directed toward said front wall;

mounting a burner cylinder on said back wall around said flame source, said burner cylinder having an open end directed toward said front wall;

locating a heating cylinder in a position coaxial to and slightly overlapping said burner cylinder, said heating cylinder having a larger diameter than said burner cylinder;

directing fresh air through the area between said heating and burner cylinders and into said heating cylinder through the end of said heating cylinder nearer said back wall;

heating the fresh air in said heating cylinder; and directing the heated air to said dryer-conditioner system from said heating cylinder.

23. The method of claim 22 additionally comprising selectively directing additional fresh air in a secondary passage extending alongside said heating cylinder; and mixing air from the secondary passage with air passing within the heating cylinder prior to directing the heated air to the dryer-conditioner system.

24. A combustion chamber for a laundry dryer system having exhaust and inlet passages coupled to a dryer and a blower for directing air along the exhaust passage, the chamber comprising:

a housing having front and back walls, side walls, and a top and bottom;

a burner mounted adjacent the back wall for projecting a flame into the chamber in the direction of the front wall;

first and second partitions extending transversely of the housing between the side walls and the top and bottom, respectively the second partition being near the midplane of the housing and the first partition being nearer to the back wall;

first and second tubes surrounding and confining said flame along at least a portion of its length, the first tube being mounted on the back wall and extending to the vicinity of the first partition, the second tube being larger in diameter than the first tube, overlapping the end of the first tube slightly, and generally coaxial with the first tube;

means in one of the side walls defining an opening adjacent the front wall for communicating with the inlet passage of the dryer system to direct heated air thereto from the housing; and means in the top defining an opening between the back wall and the first partition for admitting fresh air along a primary air path entering the second tube through an annular space at the overlapped portion of the first and second tubes to mix with the flame and continue to the opening in the side wall.

25. The combustion chamber of claim 24 further including a pair of longitudinal partitions extending upwardly from the second tube to the top of the housing to form a partially closed space above the second tube.

26. The combustion chamber of claim 25 wherein each of the first and second partitions is cut out to provide an opening in the region above the second tube and between the longitudinal partitions to provide a path for secondary air generally parallel to the axis of the second tube and outside said tube.

27. The combustion chamber of claim 26 wherein the second tube extends between and projects slightly beyond the first and second partitions and terminates short of the midplane of the housing, thereby providing a mixing chamber for primary and secondary air between the second partition and the front wall prior to the heated air leaving the chamber.

28. The combustion chamber of claim 27 further including a deflector plate mounted inside the top of the housing and extending downwardly to direct secondary air toward the primary air for improved mixing thereof.

29. The combustion chamber of claim 28 further including a vertically movable gate projecting downwardly through a slot in the top of the housing along the cut out opening in the second partition above the second tube for adjusting the amount of secondary air admitted into the housing.

30. The combustion chamber of claim 29 wherein said tubes are generally cylindrical.

31. The combustion chamber of claim 29 further including means defining an opening in the bottom of the housing between the first and second partitions for communicating with the exhaust passage of the dryer system.

32. The combustion chamber of claim 31 further including means defining a pair of passages having exit openings in the top on either side of the longitudinal partitions defining the secondary air path, said pair of passages communicating with the exhaust passage opening in the bottom to direct exhaust air through the housing on opposite sides of the second tube and secondary air path.

33. The combustion chamber of claim 32 further including means defining an opening in the second partition adjacent the bottom of the housing for admitting exhaust air from the exhaust passage into the hot air mixing chamber for return to the dryer, and an adjustable door mounted along the second partition adjacent said opening for controlling the amount of exhaust air which is returned to the dryer.

34. The combustion chamber of claim 23 further including a heat shield extending adjacent the front wall inside the housing, and a plurality of standoff elements for mounting the heat shield in spaced juxtaposition from the front wall.

35. The combustion chamber of claim 29 further including means for adjusting the gate to control the cut out opening in the second partition for the secondary air passage in accordance with the operation of the dryer.

36. The combustion chamber of claim 35 wherein the dryer system includes a timer for controlling the cycle of operation of the dryer, and wherein the gate adjusting means includes means responsive to a divide timer coupled to the cycle timer for opening the gate after a predetermined portion of the cycle has passed.

37. The combustion chamber of claim 36 wherein the divide timer is set to activate the gate adjusting means approximately 25% into the drying cycle.

38. The combustion chamber of claim 29 further including humidity sensing means positioned to monitor the humidity of exhaust air from the dryer, and means responsive to the sensing means for actuating the adjusting means to open the gate upon the humidity of the exhaust air falling below a predetermined threshold level.

39. A combustion chamber for a laundry dryer system having exhaust and inlet passages coupled to a dryer and a blower for directing air along the exhaust passage, the chamber comprising:

a housing having front and back walls, side walls, and a top and bottom;

a burner mounted adjacent the back wall for projecting a flame into the chamber in the direction of the front wall;

means defining a first passage extending from the vicinity of the back wall into the chamber for containing said flame along at least a portion of its path toward the front wall; and means defining exhaust passages extending through the combustion chamber between the top and bottom of the housing on opposite sides of said flame passage.

40. The combustion chamber of claim 39 wherein said first passage defining means include means defining an aperture part way along said passage for introducing fresh air into an air/flame mixing region.

41. The combustion chamber of claim 40 wherein said first passage defining means comprise first and second coaxial cylinders having different diameters and being slightly overlapped to define an annular space for admitting air into the air/flame mixing region within the larger diameter cylinder.

42. The combustion chamber of claim 41 wherein said exhaust passage defining means comprise a pair of transverse partitions spaced from each other along the longitudinal axis of the housing, the first one of said partitions being situated adjacent the overlapping portion of the cylinders and spaced from the back wall to provide a fresh air inlet passage opening through the top and communicating with said annular space.

43. The combustion chamber of claim 42 wherein the second of said partitions is located near the other end of the larger cylinder and separates the exhaust passages from an air return region which extends to the vicinity of the front wall of the chamber.

44. The combustion chamber of claim 43 wherein said exhaust passage defining means further comprise interior boundary walls extending from the larger diameter cylinder to the top of the chamber to provide a passage for secondary make-up air located between said exhaust passages.

45. The combustion chamber of claim 44 wherein each of the two transverse partitions has an opening extending from the larger diameter tube to the top of the chamber and between said interior boundary walls for permitting secondary makeup air to flow through the secondary air passage.

46. The combustion chamber of claim 43 wherein said first passage defining means are oriented to direct said flame from the burner at the back of the housing between the exhaust passages and into the air return region in the front end of the chamber.

47. The combustion chamber of claim 42 wherein the top of the chamber includes means defining a first opening for make-up air communicating with the inlet passage adjacent the back wall of the chamber and a second opening for exhaust gases adjacent the first opening and communicating with said exhaust passages.

48. A laundry dryer system comprising in combination:

a laundry dryer;

a combustion chamber in accordance with claim 39;

means defining inlet and exhaust passages coupled to said dryer;

means coupling the exhaust passage defining means of the combustion chamber to said exhaust passage coupled to the dryer;

means coupling the combustion chamber to said inlet passage for transferring heated air from the combustion chamber into the dryer; and a blower for directing air from the dryer along said exhaust passages and thereby drawing heated air from the combustion chamber along the inlet passage to the dryer.

* * * * *